United States Patent [19]

Zakrzewski et al.

[11] 4,075,810

[45] Feb. 28, 1978

[54] METAL WALL CONSTRUCTION FOR BUILDINGS

[75] Inventors: Andrew Steven Zakrzewski, Burlington; Roderick William Eastman, Millgrove; George Steven Ashby, Port Credit; Douglas Mel Clarkson, Brantford, all of Canada

[73] Assignee: Dominion Foundries and Steel, Limited, Burlington, Canada

[21] Appl. No.: 683,767

[22] Filed: May 6, 1976

[51] Int. Cl.[2] ..... E02D 27/00; E04C 2/38

[52] U.S. Cl. ..... 52/585; 52/169.5; 52/393; 52/588; 52/667

[58] Field of Search ..... 52/169, 534, 588, 582, 52/584, 585, 629, 393, 488, 667

[56] References Cited

U.S. PATENT DOCUMENTS

| | | | |
|---|---|---|---|
| 2,642,968 | 6/1953 | Roush et al. | 52/534 X |
| 3,067,843 | 12/1962 | Rushtoh et al. | 52/629 X |
| 3,274,739 | 9/1966 | Gregoire | 52/169 |
| 3,333,383 | 8/1967 | Raudebaugh, Jr. | 52/588 X |
| 3,481,094 | 12/1969 | Taylor | 52/534 X |
| 3,568,388 | 3/1971 | Flachbarth et al. | 52/588 |
| 3,839,839 | 10/1974 | Tillisch et al. | 52/481 X |
| 3,956,998 | 5/1976 | Bavetz | 52/481 |

FOREIGN PATENT DOCUMENTS

| | | | |
|---|---|---|---|
| 1,001,685 | 8/1965 | United Kingdom | 52/461 |

*Primary Examiner*—Alfred C. Perham
*Attorney, Agent, or Firm*—Hirons & Rogers

[57] ABSTRACT

In a metal building wall construction intended especially for house basement walls, the walls consist of edge interlocked metal panels resting on the web of an upwardly-open perimeter channel that delineates the basement floor. A flange on the channel inner side sets the depth of a poured concrete floor and acts as a screed for levelling the concrete. The perimeter channel web is wider than the panels are thick and they are supported at their inner face by spaced tabs struck up out of the perimeter channel web to leave internal drain holes which permit escape of water received in the perimeter channel. Since the thin passage between abutting edge webs unavoidably promotes capillary action whereby water can be drawn into it from the adjacent soil, the passage is provided along its length with an enlargement forming a vertical longitudinal drain passage that will trap the water moving into the passage and cause it to travel downwards to the perimeter channel and through the drain holes. Another longitudinal opening provided between the drain passage and the inner end is sealed by an appropriate material. The panel edge webs are slotted to reduce heat transfer. Other slots are provided at regular intervals and snap-in stiffeners are provided retained by these other slots to support the panels against bulging and to hold the abutting webs in close contact with one another.

8 Claims, 5 Drawing Figures

METAL WALL CONSTRUCTION FOR BUILDINGS

FIELD OF THE INVENTION

The present invention is concerned with improvements in or relating to metal wall constructions for buildings and especially, but not exclusively, to such metal constructions intended for house basement walls.

REVIEW OF THE PRIOR ART

There is a constant endeavour to provide new and better metal wall constructions for buildings in view of the wide usage of this material for this purpose, and the many advantages it possesses when so used. In practice, metal has only previously been used generally for above-ground construction because of the special problems of resistance to soil pressure, sealing against water leakage, and resistance to corrosion, that are encountered.

DEFINITION OF THE INVENTION

In accordance with the present invention there is provided a metal building wall construction comprising:

a plurality of vertically-extending panels, each comprising a body portion having inner and outer faces and inwardly-extending edge webs at each vertical edge of the body portion, the panels being disposed side by side with their edge webs abutting, the said abutting panel edge webs having registering holes therein;

at least one of the said edge webs having formed therein a vertical ridge spaced from the adjacent inner panel face; and at least one channel-section stiffening member for each panel extending between the two vertical edge webs of a panel for bracing the said abutting edge webs into contact with one another with a flange thereof engaging the inner face of the panel body portion for stiffening thereof against inwards bulging;

each stiffening member having one end shaped to fit within two registering edge web holes and to wedge against the immediately adjacent edge web in the neighbourhood of the respective web hole, and having its other end shaped to be engaged between the said vertical ridge in the other edge web of the same panel and the panel inner face upon displacement of the said other end of the stiffening member downward with its said one end engaged in the respective two registering holes, so as to be retained against the panel inner face by its engagement with the said registering apertures and vertical ridge, and so as to brace the engaged edge webs of its panel against the abutting edge webs of the immediately adjacent panels.

Preferably each said stiffening member other end embraces the respective vertical ridge and extends into the neighbourhood of the said registering holes, and the said stiffening member one end engaged in the said registering holes protrudes therethrough and overlaps the adjacent part of the stiffening member other end to prevent its upward displacement.

Also in accordance with the present invention there is provided a metal building wall construction comprising:

a plurality of vertically-extending panels each comprising a body portion having inner and outer faces and inwardly-extending edge webs at each edge of the body portion, the panels being disposed side by side with their edge webs abutting thereby forming between each two abutting edge webs a capillary passage capable of capillary action to draw moisture therein from the body portion outer faces, one edge web having therein close to the body portion inner face but spaced from said inner face a vertical longitudinal inwardly-extending ridge providing a corresponding longitudinal inwardly-extending recess on the web outer face that provides a vertical longitudinal drain passage disposed between the ends of the respective capillary passage to intercept moisture through the capillary passage and to drain such intercepted moisture to the bottom of the panel, and at least one stiffening member for each panel wedged between the two vertical edge webs to urge each edge web into close engagement with its abutting edge webs and to stiffen the panel against inwards bulging for maintenance of the said capillary passage.

DESCRIPTION OF THE DRAWINGS

A steel basement wall construction which is a particular preferred embodiment of the invention will now be described, by way of example, with reference to the accompanying diagrammatic drawing, wherein.

DESCRIPTION OF THE PREFERRED EMBODIMENTS

Figure 1:
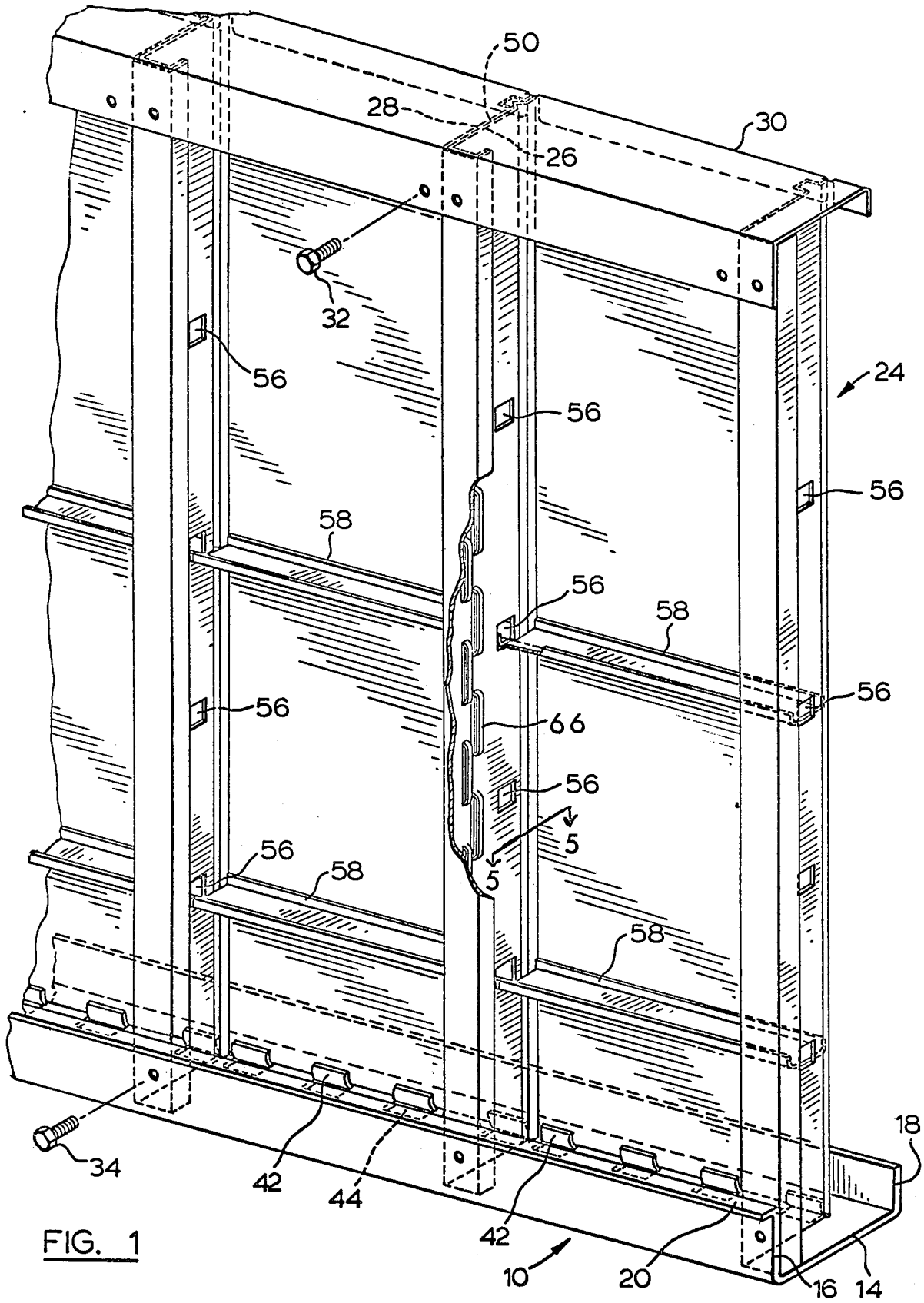
FIG. 1 is a perspective view of a section of the wall as seen from the inside.
Figure 3:
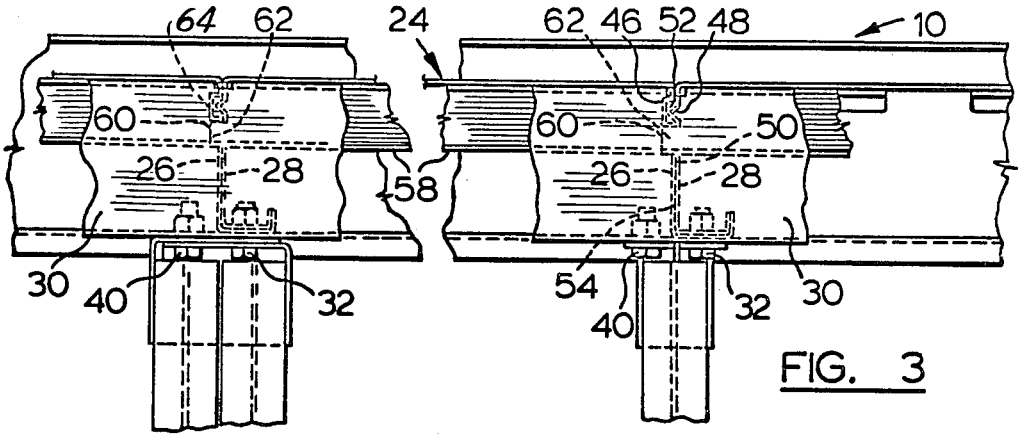
FIG. 3 is a plan view from above of the part of the wall shown in FIG. 2, parts thereof being shown broken away as necessary for clarity.
Figure 2:
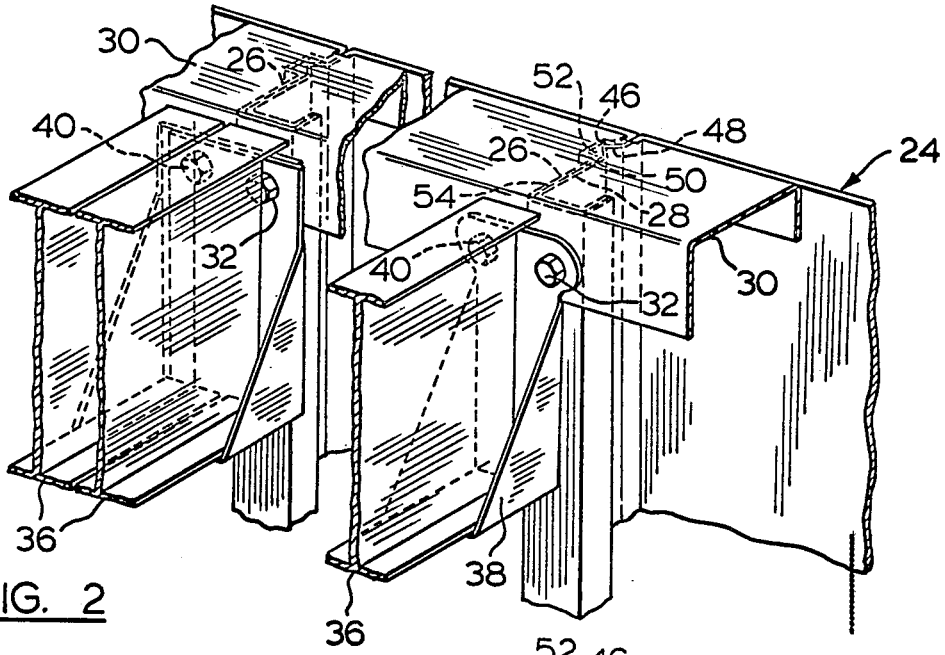
FIG. 2 is a perspective view of an upper part of the wall showing two floor/ceiling joists fastened thereto.
Figure 5:
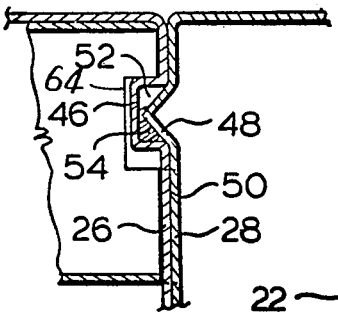
FIG. 5 is a section taken on the line 5—5 of FIG. 4.
Figure 4:
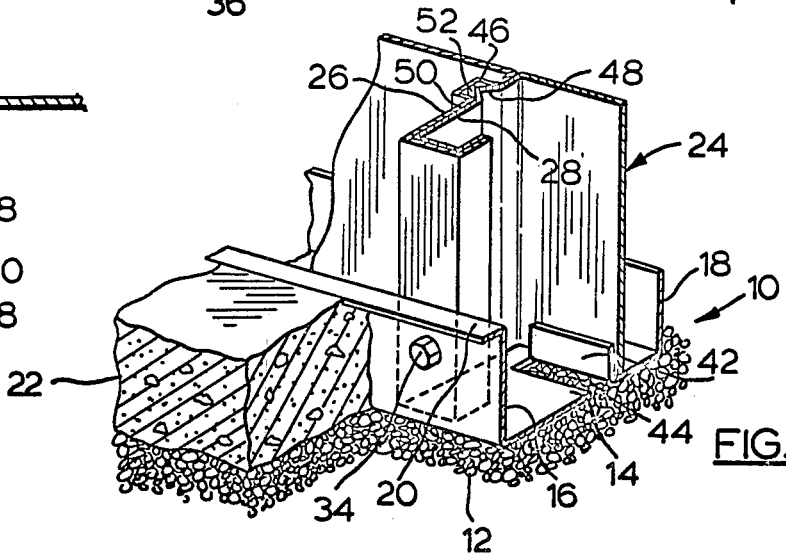
FIG. 4 is a perspective view of a bottom part of the wall to illustrate a detail.

In the construction of a basement wall and floor the foundation for the wall and form for the floor is constituted by a perimeter channel of special cross-section, indicated generally by the reference 10, this channel being laid on the ground 12 with its main web 14 horizontal. Preferably, the ground 12 is constituted by a deep layer of gravel, for example about 6 inches (15 cm) deep, to promote easy drainage away from the wall. The perimeter channel has upwardly-extending inside and outside flanges 16 and 18 respectively, and the inside flange 16 has at its upper end a horizontally-inwardly-extending flange 20. The vertical height of the flange 16 serves to determine the thickness of a concrete layer 22 forming the basement floor, and the flange 20 serves as a screed for levelling and smoothing the top surface of this layer. Another useful function of the flange 20 is to secure to the entire perimeter channel system a series of cross braces which resist movement of the channel as the exterior soil is back-filled against the wall, and/or as the cement floor is poured.

The channel is laid along the entire perimeter of the house to be erected, and the wall is formed by placing thereon a plurality of interlocking panels, the operative wall portions of which are indicated generally by reference 24. This operative wall portion has an outer face which is contacted by the exterior soil and an inner face which forms the interior basement wall, each wall-portions having along its respective vertical edges two C-shaped parallel vertical inwardly-extending edge webs 26 and 28 terminating in L-shaped flanges which will interlock with the edge webs and flanges of the immediately adjacent panels in known manner.

The wall is completed by an inverted top plate channel 30 which is laid over the tops of the panels and bolted thereto by bolts 32 which pass through the channel 30 and the L-shapeflanges. The lower ends of the panels are bolted to the perimeter channels 10 by bolts 34 in the same way as with the bolts 32. Horizontal joists 36 for the basement ceiling and the floor above are supported from the inside of the wall by hangers 38 fastened to the wall by the bolts 32 and by additional bolts 40.

The horizontal width required for the web 14 of the channel 10, in order to withstand the forces applied thereto, is greater than the corresponding thickness of the panels 24 at their edges. To oppose flexing and bulging of the panel wall portion the lower edge thereof is supported by four equally-spaced vertically-extending tabs 42, which are struck out of the material of the web 14 to leave a corresponding hole 44 therein and engage the inner face of the wall portion. The formation of the tabs 42 and holes 44 simultaneously provides for support of the panels 24 at their inner faces, and also for the provision of drainage to the porous gravel bed of the moisture that inevitably collects on the inner surface of the panels 24 and drains down to the perimeter channel. Difficulty is always experienced in obtaining adequate sealing between two abutting edge webs 26 and 28 of the two adjacent panels, since the very thin passage 50 between them unavoidably causes capillary action to take place, drawing outside moisture in between the edges. In a structure in accordance with the invention the edge web 26 is provided with a longitudinal displaced part 46 forming a vertical groove of approximately rectangular cross-section extending into the interior of the panel, while the edge web 28 is provided with a vertical ridge 48 of triangular cross-section that extends into the concave face of the groove. The diplaced part 46 forms a corresponding vertical ridge on the other side of the edge web 26. The ridge 48 and the groove thereby form between themselves a vertical drainage passage 52 which is too big in cross-section for capillary action to be effective. Any liquid which reaches the passage 52 therefore is effectively trapped and drains downwards to the perimeter channel 10 and out of the drainage holes 44. The other enlarged part of the passage 50 beyond the drain passage 52 is filled with a sealant 54 to prevent any further progress of the water through the passage. An equivalent effect could be obtained however by a groove in one edge cooperating with a flat face or two registering grooves in the two abutting faces.

Each edge web 26 and 28 is provided with a number of equally-vertically-spaced slots 56 which permit the rapid installation of channel-shaped stiffeners 58. The slots in abutting panel edges register with one another. Each stiffener has an open-sided protruding end 60 which is inserted into the appropriate pair of registering slots 56 to protrude out of the other side with the intact channel side inwards while the stiffener is inclined upwardly; the stiffener is then rotated downward until it is wedged in near-horizontal position, its length being just too long that the last few degrees of travel must be effected by forcing. Thus, the usual small dimensional discrepancies found in commercial manufacture are overcome; it is found that as long as the stiffeners are inclined at an angle of less than about 7° they will be self-locking in position. The downwardly-moving straight end 62 has a notch 64 therein that embraces the part 46 of the edge web 26 forming the respective, vertical ridge this engagement retaining the stiffener against inward movement, so that it is retained without the use of tools; the end 60 of the next-placed stiffener protruding through the registering slots 56 overlaps the adjacent end of the previously-placed stiffener to further prevent its upward displacement.

The stiffeners have several important effects, in that they permit the use of wider panels of thinner material, the stiffeners being located appropriately along the length of the panel to prevent inward bulging that would otherwise take place under the pressure of the back-filled soil. Another important effect is to maintain the edge webs 26 and 28 in close engagement with one another, so that the sealing of the drainage passage 50 is maintained. The edge webs of the panels are also provided with a thermal break which in this embodiment is constituted by at least two rows of elongated struck-out parts 66, the parts of the two rows being staggered relative to each other as shown, thereby reducing the heat transmission through the webs.

We claim:

1. A metal building wall construction comprising:

a plurality of vertically-extending panels, each comprising a body portion having inner and outer faces and inwardly-extending edge webs at each vertical edge of the body portion, the panels being disposed side by side with their edge webs abutting, the said abutting panel edge webs having registering holes therein;

at least one of the said edge webs having formed therein a vertical ridge spaced from the adjacent inner panel face; and at least one channel-section stiffening member for each panel extending between the two vertical edge webs of a panel for bracing the said abutting edge webs into contact with one another with a flange thereof engaging the inner face of the panel body portion for stiffening thereof against inwards bulging;

each stiffening member having one end shaped to fit within two registering edge web holes and to wedge against the immediately adjacent edge web in the neighbourhood of the respective web hole, and having its other end shaped to be engaged between the said vertical ridge in the other edge web of the same panel and the panel inner face upon displacement of the said other end of the stiffening member downward with its said one end engaged in the respective two registering holes, so as to be retained against the panel inner face by its engagement with the said registering apertures and vertical ridge, and so as to brace the engaged edge webs of its panel against the abutting edge webs of the immediately adjacent panels.

2. A wall construction as claimed in claim 1, wherein each said stiffening member other end embraces the respective vertical ridge and extends into the neighbourhood of the said registering holes, and the said stiffening member one end engaged in the said registering holes protrudes therethrough and overlaps the adjacent part of the stiffening member other end to prevent its upward displacement.

3. A metal building wall construction comprising:

a plurality of vertically-extending panels each comprising a body portion having inner and outer faces and inwardly-extending edge webs at each edge of the body portion, the panels being disposed side by side with their edge webs abutting thereby forming between each two abutting edge webs a capillary passage capable of capillary action to draw moisture therein from the body portion outer faces, one edge web having therein close to the body portion inner face but spaced from said inner face a vertical longitudinal inwardly-extending ridge providing a corresponding longitudinal inwardly-extending recess on the web outer face that provides a vertical longitudinal drain passage disposed between the ends of the respective capillary passage to intercept moisture passing through the capillary passage and to drain such intercepted moisture to the bottom of the panel, and at least one stiffening member for each panel wedged between the two vertical edge webs to urge each edge web into close engagement with its abutting edge web and to stiffen the panel against inwards bulging for maintenance of the said capillary passage.

4. A wall construction as claimed in claim 3, wherein the said inwardly-extending ridge and corresponding recess is provided in one vertical edge web of a panel and another outwardly-extending ridge is provided in the other vertical edge web of the same panel, the said another ridge registering with and entering into the said corresponding recess of an abutting panel to form the said vertical drain passage.

5. A wall construction as claimed in claim 4, wherein the said vertical drain passage has a sealing material disposed therein at its junction with the inner part of the capillary passage.

6. A wall construction as claimed in claim 3, wherein the panel edge webs have registering holes therein, and each stiffening member is of channel-section with a flange thereof engaging the panel inner wall for stiffening thereof, each stiffening member having one end shaped to fit within two registering edge web holes and to wedge against the immediately adjacent edge web in the neighbourhood of the respective web hole, and having its other end shaped to be engaged between the said vertical ridge in the other edge web of the same panel and the panel inner face upon displacement of the said other end of the stiffening member downward with its said one end engaged in the respective two registering holes, so as to be retained against the panel inner face by its engagement with the said registering apertures and vertical ridge.

7. A wall construction as claimed in claim 3 wherein the edge webs of each panel are provided with apertures for the passage of electric cables and the like, and with longitudinal slits providing a longitudinally-extending thermal break, and wherein the edge web provided with the said vertical longitudinal ridge has the apertures and slits disposed between the said vertical ridge and the edge web inner edge.

8. A wall structure as claimed in claim 4 wherein each edge web of the panel is provided with apertures for the passage of electric cables and the like, and with longitudinal slits providing a longitudinally-extending thermal break, the said apertures and slits being disposed between the respective vertical ridge and the edge web inner edge.

* * * * *